United States Patent [19]

Dorius

[11] 4,129,121

[45] Dec. 12, 1978

[54] EXHAUST HOOD CANOPY HAVING A MULTI SLOT VENTURI OUTLET

[75] Inventor: John O. Dorius, Glendale, Calif.

[73] Assignee: Elsters, Inc., Hollywood, Calif.

[21] Appl. No.: 799,389

[22] Filed: May 23, 1977

[51] Int. Cl.[2] ..... F21C 15/08; F23J 11/00

[52] U.S. Cl. ..... 126/299 D; 55/DIG. 36; 98/36

[58] Field of Search ..... 126/299 D; 98/36, 40 D, 98/115 R; 55/DIG. 36

[56] References Cited

U.S. PATENT DOCUMENTS

| | | | |
|---|---|---|---|
| 3,303,839 | 2/1967 | Tavan | 126/299 D |
| 3,890,887 | 6/1975 | Kaufman et al. | 126/299 D |
| 3,980,072 | 9/1976 | Jacobs | 126/299 D |
| 4,047,519 | 9/1977 | Nett | 126/299 D |

*Primary Examiner*—Ronald C. Capossela

*Attorney, Agent, or Firm*—Spensley, Horn & Lubitz

[57] ABSTRACT

An exhaust hood may be fabricated having a plurality of slots disposed at one side of the cavity formed by the hood to form a substantially streamlined, and uniform air flow across the cavity to efficiently entrain smoke laiden air without requiring large volumes of air flow. This type of air flow pattern within the cavity is obtained by appropriately baffling the air supplied to the multiple slots, forming a number of high velocity venturi slots, and canting oppositely disposed inlet filters away from the outlet slots. The uniform air flow creates a low pressure area which then draws underlying smoke laiden air upward. The hood canopy may be provided with a second source of tempered air to direct comfort condition air through a slot on the face of the hood along the cooking line for the safety and comfort of the workers below.

3 Claims, 2 Drawing Figures

EXHAUST HOOD CANOPY HAVING A MULTI SLOT VENTURI OUTLET

BACKGROUND OF THE INVENTION

1. Field of the Invention

The present invention relates to the field of air conditioning, treatment and ventilation apparatus and in particular to exhaust hoods disposed over cooking surfaces.

2. Description of the Prior Art

As occupational health and safety standards and expectations of the industry increases, greater and greater performance parameters are required from air treatment and ventilation apparatus. At the same time as greater performance is required, the cost of energy of all forms is increasing at an accelerating rate. Therefore, the cost effectiveness of the operation of air treatment and ventilation apparatus is an increasingly important factor as higher demands are made upon efficiency. Often times, the demand for more energy efficient ventilation apparatus is in conflict with the demand for high performance ventilation apparatus. Therefore, there is an ever increasing need for ventilation apparatus, such as an exhaust hood disposed over a cooking line, which can evacuate large amounts of grease and smoke laiden air at high rates and provide a suitable working environment without the need for large volumes of air flow or large volumes of tempered or conditioned air.

BRIEF SUMMARY OF THE INVENTION

The present invention is an apparatus comprising a supply plenum which communicates with a source of air. The supply plenum has an outlet. An exhaust duct communicates with a sink of air. The exhaust duct has an inlet. The exhaust duct and supply plenum together form a hood cavity. The inlet and outlet are disposed on opposite sides of the hood cavity. The outlet includes a plurality of channels, each terminating in an open slot. By virtue of this combination an apparatus is devised which provides a substantially streamlined, and uniform pattern of air flow across the hood cavity without requiring large volumes of air flow.

The present invention may further include within the outlet a pervious means for uniformly distributing air into the plurality of channels. The supply plenum may also be comprised of at least two independent plenums, a first plenum communicating with the outlet and a second plenum communicating with an air curtain slot. The air curtain slot directs air downwardly along one side of the apparatus, external to the hood cavity and directly above the cooking line. The air is comfort conditioned such that personnel working along the cooking line may be maintained at a safe and comfortable level despite their proximity to high temperature surfaces and gases for prolonged periods. The inlet may include at least one filter disposed at an angle such that the upper portion of the filter is more distant from the open slots of the outlet than the lower portion of the filter. These and other embodiments and advantages of the present invention may be better understood by viewing the following FIGURES in light of the detailed description of the preferred embodiments.

DETAILED DESCRIPTION OF THE PREFERRED EMBODIMENTS

The present invention is a hood for removal of smoke, gases and vapors from a heated surface, typically a commercial cooking line. The hood is comprised of a first and second plenum, an exhaust duct, a housing, an outlet, an inlet and a cooking line ventilation slot. The first plenum communicates with a first source of tempered air. The second plenum communicates with a second source of tempered air. The exhaust duct communicates with a sink of air. The housing communicates with the first and second plenums and the exhaust duct. The housing forms a hood cavity, an exhaust chamber and a first and second chamber. The first plenum is coupled to the first chamber and the second plenum is coupled to the second plenum. The outlet has a plurality of slots communicating with one side of the hood cavity and a third chamber divided into a plurality of channels and a mixing subchamber. The first chamber communicates with the mixing subchamber through a plurality of sharp edged apertures while the plurality of channels communicates with the mixing chamber through a pervious plate. The inlet has at least one filter disposed thereacross at an angle such that the lower portion of the filter is closer to the plurality of slots than the upper portion of the filter. The hood cavity communicates with exhaust duct through the inlet. Finally, a cooking line ventilation slot or air curtain slot is disposed in the housing and directs air flowing therethrough to regions below the ventilation slot. The ventilation slot communicates with the second chamber. By virtue of this combination of elements a hood may be devised which provides a substantially streamlined, high velocity and uniform pattern of air flow across the hood cavity and a flow of comfort condition air along a cooking line without requiring a large volume of air flow. Thus, the hood is charaterized by high performance parameters, i.e. a capacity to withdraw large volumes of grease and smoke laiden air and to provide comfortable working temperature for personnel while providing a high degree of cost and energy effeciency.

Figure 1:
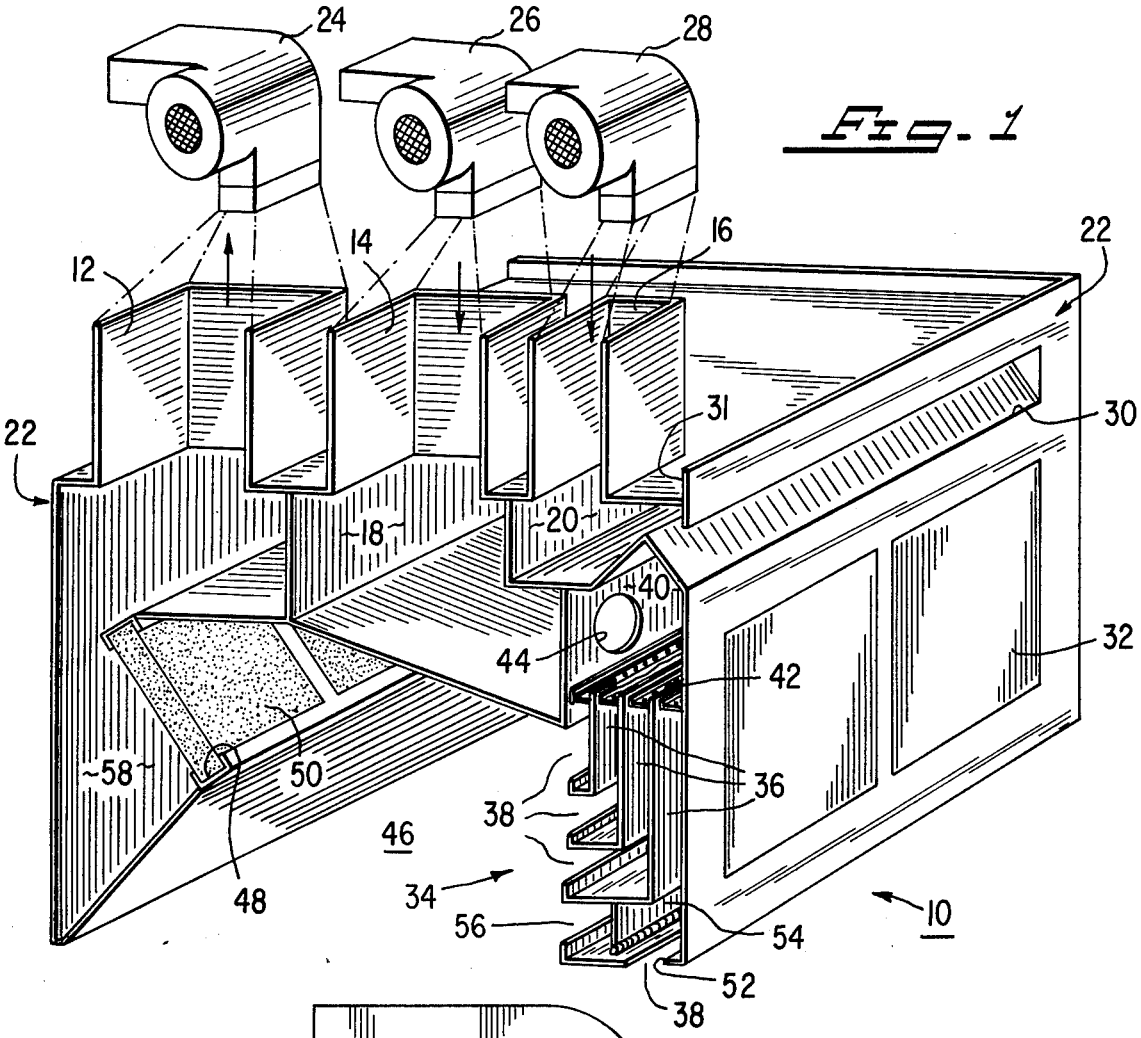
FIG. 1 is a perspective cutaway of one embodiment of the present invention showing the arrangement of the multiple slots with respect to the cavity, duct and plenums.

The invention may be better understood by viewing FIG. 1. The embodiment of FIG. 1 illustrates a hood 10 which has an exhaust duct 12 and supply ducts 14 and 16. The first supply duct 14 communicates with a first supply plenum 18 formed by what may be collectively denoted as a housing 22. The second supply duct 16 communicates with a second supply plenum 20, also defined by housing 22. Exhaust duct 12 communicates with a sink of air, typically through ducting or conduits well known to the art through an exhaust fan 24, also well known to the art. The supply of duct 14 communicates through ductwork or conduits to a first source of air which is digramatically shown in FIG. 1 as a supply fan 26 communicating with the environment. However, it must be expressly understood that the present invention includes the embodiment wherein both supply plenums 14 and 16 communicate with a source of tempered air which has been humidified, filtered, heated or cooled, utilizing apppartus and designs well known to the art according to well understood principles. Thus, for the purpose of the present illustration, it will be assumed that a means for conditioning or tempering the air is included as part of supply fans 26 and 28. Supply duct 16 communicates by conduits or ductwork, possibly through a means for tempering the air, to supply fan 28.

Plenum 20 extends to the front portion of housing 22 and terminates in an open air, curtain slot or cooking line ventilation slot 30. Air passing through slot 30 is directed down the face 32 of housing 22 towards the cooking line below. By virtue of the deflector ledge 31 and the surface friction between face 32 and air exiting from slot 30 substantially all of the comfort conditioned air delivered through supply plenum 20 reaches the general region of personnel standing just below and in the vicinity of face 32 of housing 22. Thus, personnel who must maintain prolonged hours in close proximity to a high source of radiant and conductive heat can be maintained in an environment having reasonablly tempered air and comfortable temperatures. The chronic effects of prolonged exposure to hot grease and smoke vapors and radiant temperatures may thus be substantially mitigated, and the health, safety and occupational environment of such personnel substantially improved.

Chamber 18 communicates with an outlet generally denoted by the reference character 34. In the embodiment of FIG. 1, outlet 34 includes a plurality of channels 36 each terminating in one or more venturi slots 38. The opposing end of each channel 36 communicates with a mixing subchamber 40 through a pervious means 42. Pervious means 42 is shown in FIG. 1 as being a plurality of baffle plates provided with a multiplicity of holes. Each baffle plate is welded or otherwise affixed to the sides which form channel 36 and thus form the bottom of mixing subchamber 40. A single plate to which the channel sides might be welded or otherwise affixed could alternatively be provided as well as any other means for metering, and uniformly distributing the air within subchamber 40 along the entire length and plurality of channels 36. Mixing subchamber 40 communicates with plenum 18 through a plurality of apertures 44, one of which is shown in FIG. 1. In the example illustrated in FIG. 1 aperture 44 is shown as a circular cutout in the wall common to chamber 18 and subchamber 40. Typically, aperture 44 is provided with unpolished and sharp edges, such as would be created by punching through sheet metal. The sharp edges of apertures 44 help to create a turbulence of air passing therethrough which equalizes the pressures within subchamber 40 along its length. Clearly, any other means well known to the art for creating turbulence or distributing air within a region may be used in place of apertures 44.

Housing 22 defines a hood cavity 46 which is typically disposed directly above the cooking surface. In the embodiment illustrated in FIG. 1 slots 38 are disposed on one side of cavity 46 while an inlet 48 is disposed on the opposite side. In the illustration, inlet 48 has at least one air filet 50 disposed across inlet 48 at an angle canted backwards from slots 38 such that the upper portion of filter 50 is more distant from the plane in which the majority of slots 38 lie than the lower portion of filter 50. Some of the slots may be disposed in a plane having a normal oriented in a direction other than the side of cavity 46 having inlet 48. For example, slot 52 is formed at the base of the lowest most channel 36 and directs air from the channel downwardly towards the cooking line to further enhance the effect of air curtain slot 30 and to confine the flow of grease and smoke laiden vapors within cavity 46. A damper 54 is disposed within this channel and may selectively divert air within the channel between slot 52 and slot 56. Slot 56 is oriented inwardly towards cavity 46. Damper 54 may be operated by any electrical, pneumatic, hydraulic, mechanical or other means well known to the art to selectively divert air between the corresponding plurality of slots associated therewith.

Inlet 48 communicates with a chamber 58 which in turn is coupled to exhaust duct 12. Thus, a substantially streamlined, high volocity flow of air is generated by venturi slots 38 creating a low pressure in the lower portion of cavity 46. The air stream flows through filters 50 into cavity 58 and upwardly through exhaust duct 12. The inclination of filters 50 in a backwards direction as shown in FIG. 1 helps to prevent the entrained smoke and grease which is entrained into the supply air stream entrance cavity 46 via slots 38 from flowing past the filters so and out of cavity 46.

Figure 2:
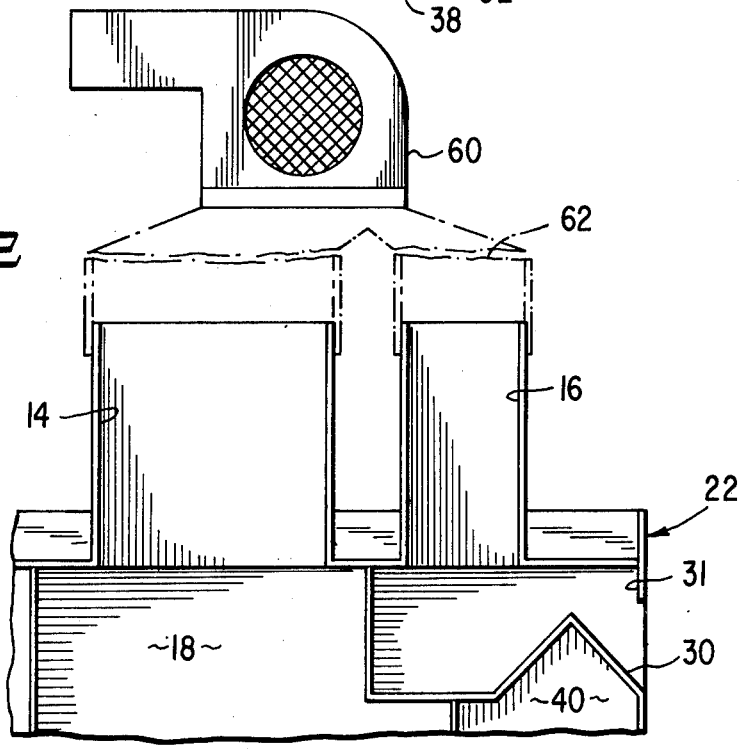
FIG. 2 is a cross section of a portion of the plenums shown in FIG. 1 coupled to a source of air in another embodiment.

FIG. 2 illustrates another embodiment of the present invention wherein ducts 14 and 16 are coupled to a single supply fan 60 through appropriate ducting or conduits 62. In this embodiment the same means for treating or tempering the air may be provided for supply ducts 14 and 16 which may then be coupled in the manner shown or in any equivalent manner. Such applications are typically to be expected in more temperate climates where the comfort conditioned air forced through ducts 16 is generally closer to ambient temperature, thus permitting in effect the same conditioning means for the make-up air through plenum 14 to provide the comfort conditioned air.

The operation of the present invention may now be understood in light of the above description as follows. Assume for example that housing 22 of FIG. 1 forms a 24 foot long hood above a 24 foot long cooking line. Further assuming winter conditions of 0° F. outside and inside temperatures of 72° F., the exhaust volume for hood 10 may be set at 5550 CFM. Although FIG. 1 shows a single exhaust fan 24, in a typical installation a plurality of exhaust ducts 12 and exhaust fans 24 may be provided for hood 10. The supply air entering into the hood via slot 38 may typically be set at 3850 CFM with the remaining portion, 1650 CFM supplied to the hood area outside the hood via slot 30. Assuming two exhaust fans 24 the approximate flow volume rate and temperature within exhaust duct 12 would be 2775 CFM at 1600 feet per minute and 90° F. At the surface of filters 50 the approximate maximum velocity would then be set at 500 feet per minute with temperature at approximately 90° F. By reason of natural convection and by reason of the low pressure area created by the streamline within cavity 46, smoke laiden air rising from the heated surface below cavity 46 will typically have a volocity of 400 feet per minute and a temperature of approximately 200° F. at the flue gas outlet of the grill, oven or range below. The layers of steamlined air set up within cavity 46 by slots 38 will typically have a temperature of 90° F. and velocities varying from layer to layer from 180 feet per minute downward. However, at the slot apertures 38, in the case where the intake or supply air taken through duct 14 is not tempered the velocity is approximately 180 feet per minute at 0° F. assuming the outside air is also at 0°. In the configuration shown in FIG. 1 the velocity at the opening of slot 52 averages about 550 per minute. Clearly, during the winter months damper 54 would be rotated downwardly such that the cold, untempered winter air would be selectively diverted through slot 56 across cavity 46. However, during the summer months or more temperate weather, damper 54 would be disposed as shown in FIG. 1 and would direct the make-up air downward through slot 52 along the cooking line for the comfort and safety of working personnel. The untempered make-up air travels through channels 36 and in mixing subchamber 40 at a position just inside aperture 44 at an approximate velocity of 500 feet per minute. However, on the other side of aperture 44 within chamber 18 the velocity rises to 1700 feet per minute and above. Typically, tempered air is provided by suitable means through supply fan 28 and duct 16. In the illustrated example, the tempered air at 72° flows within duct 16 at approximately 650 feet per minute. The exit velocity of such tempered air from slot 30 is about 200 feet per minute and is directed downwardly across face 32 of hood 10 where it drops to approximately 20 feet per minute at 72° F. along the cooking line below the front edge of housing 22. Clearly, in the embodiment of FIG. 2 in a climate where the ambient temperature is temperate, untreated air may be provided by a single supply fan to ducts 14 and 16, or the degree of tempering required may be so small that both the make-up and the comfort condition air may be simultaneously tempered by the same means as shown in FIG. 2.

It is to be understood that the above described embodiments have been chosen only for the sake of clarity and illustration and that the velocities, temperatures and air volumes will necessarily change with design choices selected by the user, and environmental conditions as well as other modifications which might be made by practictioners with ordinary skill in the art. Thus, the following claims are not to be limited in scope by the particular embodiment which has been discussed above but are to include all equivalents and modifications which might be made with a person having ordinary skill in the arts.

I claim:

1. A hood for removal of smoke, gases and vapors from a heat surface comprising:

a first plenum communicating with a first source of tempered air;

an exhaust duct communicating with a sink of air;

a housing communicating with said first and second plenums and said exhaust duct, said housing forming a hood cavity, an exhaust chamber, and a first chamber and a second chamber, said first plenum being coupled to said first chamber, said second plenum being coupled to said second chamber;

an outlet having a plurality of slots communicating with one side of said hood cavity and a third chamber divided into a plurality of channels and a mixing subchamber, said first chamber communicating with said mixing subchamber through a plurality of sharp edged apertures, said plurality of channels communicating with said mixing subchamber through a pervious plate;

an inlet having at least one filter disposed thereacross at an angle wherein the lower portion of said filter is closer to said plurality of slots of said outlet than the upper portion of said filter, said hood cavity communicating with said exhaust duct through said inlets; and a cooking line ventilation slot disposed in said housing and directing air flowing therethrough to regions below said ventilation slot, said ventilation slot communicating with said second chamber, whereby a hood is devised which provides a substantially streamline, high velocity and uniform pattern of air flow across said hood cavity and a flow of comfort conditioned air along a cooking line with requiring a large volume of air flow.

2. The hood of claim 1 wherein at least one damper is disposed in said outlet to selectively direct air flow between at least two of said slots.

3. A hood for removal of smoke, gases and vapors from a heat surface comprising:

a first plenum communicating with a first source of air;

an exhaust duct communicating with a sink of air;

a housing communicating with said first and second plenums and said exhaust duct, said housing forming a hood cavity, an exhaust chamber, and a first chamber and a second chamber, said first plenum being coupled to said first chamber, said second plenum being coupled to said second chamber;

an outlet having a plurality of slots communicating with one side of said hood cavity and a third chamber divided into a plurality of channeled subchambers and a mixing subchamber, said first chamber communicating with said mixing subchamber through a means for producing turbulence, said plurality of channeled subchambers communicating with said mixing subchamber through a pervious plate;

an inlet having at least one filter disposed thereacross at an angle wherein the lower portion of said filter is closer to said plurality of slots of said outlet than the upper portion of said filter, said hood cavity communicating with said exhaust duct through said inlets; and whereby a hood is devised which provides a substantially streamline, high velocity and uniform pattern of air flow across said hood cavity.

* * * * *